US009420934B1

(12) United States Patent
Koo et al.

(10) Patent No.: US 9,420,934 B1
(45) Date of Patent: Aug. 23, 2016

(54) DETACHABLE LONG-HANDLED CONNECTOR FOR CLEANING IMPLEMENTS

(71) Applicants: Ronald C. Koo, Las Vegas, NV (US); Sandra Kau-Yu Koo, Las Vegas, NV (US)

(72) Inventors: Ronald C. Koo, Las Vegas, NV (US); Sandra Kau-Yu Koo, Las Vegas, NV (US)

( * ) Notice: Subject to any disclaimer, the term of this patent is extended or adjusted under 35 U.S.C. 154(b) by 580 days.

(21) Appl. No.: 13/853,731

(22) Filed: Mar. 29, 2013

Related U.S. Application Data

(60) Provisional application No. 61/617,223, filed on Mar. 29, 2012.

(51) Int. Cl.

| | |
|---|---|
| ***A46B 5/00*** | (2006.01) |
| ***B25G 3/02*** | (2006.01) |
| ***B25G 3/12*** | (2006.01) |
| ***B25G 3/28*** | (2006.01) |
| ***A47L 13/46*** | (2006.01) |

(52) U.S. Cl.
CPC ..... *A47L 13/46* (2013.01); *A46B 5/0095* (2013.01); *B25G 3/02* (2013.01); *B25G 3/12* (2013.01); *B25G 3/28* (2013.01)

(58) Field of Classification Search
CPC ..... A46B 5/0095; B25G 1/00; B25G 3/02; B25G 3/12; B25G 3/28; A47L 13/46
See application file for complete search history.

(56) References Cited

U.S. PATENT DOCUMENTS

| | | | | | |
|---|---|---|---|---|---|
| 1,929,848 | A * | 10/1933 | Neely | A47L 13/24 | 15/143.1 |
| 4,169,297 | A * | 10/1979 | Weihrauch | B25G 3/24 | 15/145 |
| 4,247,216 | A * | 1/1981 | Pansini | B25G 3/18 | 15/1.7 |
| 5,154,465 | A * | 10/1992 | Pakosh | A01B 1/18 | 294/115 |
| 5,366,314 | A | 11/1994 | Young | | |
| 5,630,243 | A * | 5/1997 | Federico | A47K 11/10 | 15/104.94 |
| 7,059,008 | B2 * | 6/2006 | Morgan | A47K 11/10 | 15/147.1 |
| 7,386,913 | B2 * | 6/2008 | Jackson | A46B 7/04 | 15/145 |

* cited by examiner

*Primary Examiner* — Randall Chin
(74) *Attorney, Agent, or Firm* — John C. Lambertsen

(57) ABSTRACT

A long-handled connector for cleaning implements utilizes a cable and a remotely located lever to selectively connect to and disconnect from a cleaning implement fixture, such as a mop head fixture. Outwardly-biased locking tabs project from an end of an elongate handle and engage with locking slots formed in a cleaning implement receiving base upon insertion of the handle end. Disconnection of the handle and base occurs upon the repositioning of the remotely-located lever, which is communicated to the locking tabs through an internally-extending, attached cable, resulting in the retraction of the locking tabs from within the locking slots, and the disconnection of the handle from the cleaning implement receiving base.

2 Claims, 4 Drawing Sheets

10
14
18
24
26
28
34
36
42
48
54
58
66
72
76
78
86
92
94
96
98
2

DETACHABLE LONG-HANDLED CONNECTOR FOR CLEANING IMPLEMENTS

RELATED APPLICATIONS

The present application claims the benefit of priority under 35 USC §119(e) to U.S. Provisional Application No. 61/617,223, filed on Mar. 29, 2012, which is incorporated by reference herein for all that it contains.

BACKGROUND OF THE INVENTION

1. Field of the Invention

The present invention relates to long-handled cleaning implements and, more particularly, to such implements with detachable handles. More specifically, the present invention relates to a remotely-detachable elongate handle connector for cleaning implements.

2. Description of the Related Art

Wet mops are widely used to clean the floors of homes and offices, as well foot-traffic surfaces on boats (decks) and similar surfaces found on trains, busses, and motorhomes. Certain commercial areas make frequent use of wet mops due to high foot traffic, such as hotels, shopping malls, airports, and train/bus stations. In those commercial areas where higher levels of cleanliness are of utmost importance, such as in restaurants and hospitals—as well as in bathrooms/restrooms, the use of wet mops is of vital importance.

Such mops typically consist of three components: a mop handle; a mop head; and a mop fixture that connects the handle to the mop head. The mop heads usually include a plurality of flexible strands (often termed "threads") of such liquid-absorbing materials as cotton, polyester, rayon/viscose, acrylic, and the like. A holding device is also typically part of the mop head, having a mechanism that permits the releasable clamping of the mop threads as well as a structure used to connect the mop head to the handle.

The manner in which the mop handle engages the mop fixture has proved troublesome with various past designs. The heavy usage forces imposed upon industrial mops has caused the connectors to fail. One solution has been proposed in U.S. Pat. No. 5,366,314 to Young. The mop threads are shown held within a plastic holder. A cylindrical boss is attached to or formed in an upper surface of the holder, and is provided an internal, threaded socket.

A cylindrical socket adapted to receive an end of a handle has formed a connector at an opposite end consisting of a central hollow threaded spigot and an outer, surrounding shroud. When attachment to the mop fixture is desired the threaded spigot is received within and matingly-engages with the threaded cylindrical boss. When the two are tightly fastened, the mop is ready for use. Removal requires unscrewing the handle connector from within the mop fixture.

These previously known mop fixtures all necessitate manual adjustment by the user. In order to connect the mop fixture to the handle and to set and tightly hold the mop requires the user to make manual adjustments to both parts of these handle/fixture/mop connections.

A further disadvantage of many of these assemblies—they have been designed specifically for use with wet mops, and do not present a universal manner of attachment of other cleaning applications or of other types of long-handled tools and implements.

SUMMARY OF THE INVENTION

The present invention utilizes an extended cable connection between a mechanically-controlled engagement mechanism and a release/engagement lever located adjacent a hand grip portion of the connector. Activation of the release/engagement lever by a user enables the remote attachment or detachment of a mop head (or other janitorial tool or implement). A user is no longer required to grasp and manipulate the mop head to connect or disconnect the head from the handle.

An aspect of embodiments in accordance with the present invention is a connector comprising two engageable components for mounting of an elongate handle and an implement fixture respectively, one of said components having a pair of locking tabs and a remotely located lever in mechanical communication with said pair of locking tabs, said pair of locking tabs having a first outwardly extending position and a second inwardly retracted position in response to a first and a second position of said remotely located lever, said one component being mounted on said elongate handle, and the other component being mounted to said implement fixture, the other component comprising a receiving base formed in said implement fixture and adapted to receive an end of said elongate handle, said receiving base having a pair of apertures formed therein, said pair of apertures configured and positioned to receive said pair of locking tabs in a manner wherein said locking tabs selectively extend through said apertures and project from an outer surface of said receiving base, upon insertion of an end of said elongate handle into said receiving base.

Another aspect of embodiments in accordance with the present invention is a long-handled connector for cleaning implements comprising: an elongate handle having a first end and a second end; a pair of outwardly biased locking tabs projecting from an outer surface of said elongate handle adjacent said second end; a release/engagement lever projecting from an outer surface of said elongate handle at a lateral location along said elongate handle remote from said locking tabs; a cable extending within said elongate handle and mechanically connecting said release/engagement lever with said pair of locking tabs; and a receiving base having a pair of locking slots formed therein, said receiving base adapted to receive said second end of said elongate handle and said pair of locking slots positioned to releasably receive said pair of locking tabs upon insertion of said second end of said elongate handle into said receiving base, wherein said receiving base is formed in a fixture for said cleaning implements.

Another aspect of embodiments in accordance with the present invention is a mop head comprising: a mop head fixture; a plurality of flexible strands attached to said mop head fixture; an outer sleeve slidably attached to said mop head fixture in a manner defining a first lateral slidable position and a second lateral slidable position relative to said mop head fixture, wherein an edge of said outer sleeve lies adjacent a first upper band of said plurality of flexible strands at said first lateral slidable position of said outer sleeve and wherein said edge of said outer sleeve lies adjacent a second upper band of said plurality of flexible strands at said second lateral slidable position of said outer sleeve.

Another aspect of embodiments in accordance with the present invention is a connector comprising two engageable components for mounting of an elongate handle and an implement fixture respectively, one of said components comprising a strong magnet attached at a first end of said elongate handle; and the other component being mounted to said implement fixture, the other component comprising a receiving base formed in said implement fixture and adapted to receive said first end of said elongate handle, and further comprising a ferrous metal piece received within said receiving base and attached thereto at a surface positioned to engage said strong magnet when said first end of said elongate handle is received by said receiving base.

These and other objects, aspects, and features of the present invention will be better understood from the following description of embodiments when read in conjunction with the appended drawing figures.

BRIEF DESCRIPTION OF THE DRAWINGS

Embodiments in accordance with the present invention are described below in connection with the accompanying drawing sheets.

DETAILED DESCRIPTION OF THE PREFERRED EMBODIMENTS

The detachable long-handled connector for cleaning implements is disclosed herein with respect to exemplary embodiments. The embodiments are disclosed for illustration of the detachable long-handled connector for cleaning implements and a manner of operation, and are not limiting except as defined in the appended claims.

Figures 1, 1A, 1B, 2:
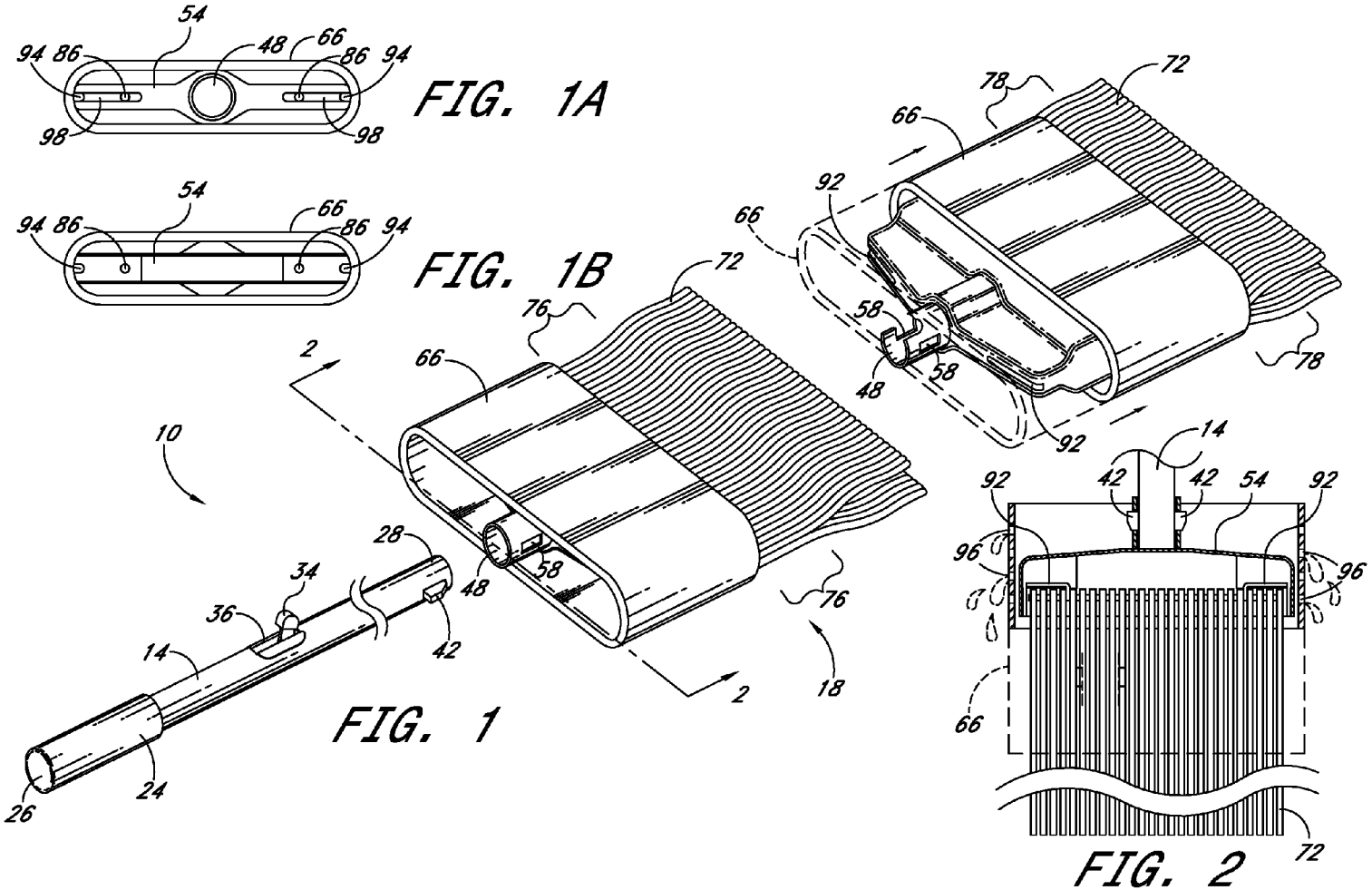
FIG. 1 is an exploded, partial perspective view, with portions shown in phantom, of a manner of attaching a handle to a mop head, the mop head shown is provided with a movable sleeve, all in accordance with the present invention.
FIG. 1A is a top plan view of the mop fixture shown in FIG. 1.
FIG. 1B is a bottom plan view of the mop fixture shown in FIG. 1.
FIG. 2 is a cross-section of the mop head taken along line 2-2 of FIG. 1.

Reference is now made to the drawings wherein like structures refer to like parts throughout. In FIG. 1 a long-handled cleaning implement 10 consists of an elongate handle 14 and a mop head 18. A grip 24 is attached to a first end 26 of the elongate handle 14, with a second end 28 configured for attachment to suitably configured cleaning implements, such as the mop head 18. A release/engagement lever 34 extends through a lever slot 36 formed in the elongate handle 14, which is located in convenient proximity to the grip 24.

Fore and aft movement of the release/engagement lever 34 results in a corresponding extension and retraction movement of a pair of locking tabs 42 located adjacent the second handle end 28 (only one shown in FIG. 1). A circular receiving base 48 is formed in a fixture 54 of the mop head 18. The receiving base 48 is configured to slidably receive the second handle end 28.

When a user desires to connect the elongate handle 14 with the mop head 18 (or other implement), the second handle end 28 is positioned into axial alignment with the receiving base 48, and then is slidably inserted therein. The pair of locking tabs 42 each have an angled leading edge, and when the second handle end 28 enters the circular receiving base 48 the pair of locking tabs 42 are inwardly forced into (within) the elongate handle 14.

A pair of locking slots 58 are formed in the receiving base 48 at a location spaced from an opening of the receiving base. Upon insertion of the elongate handle 14 a sufficient distance into the receiving base 48 each of the pair of locking tabs 42 become laterally aligned with the pair of locking slots 58. The pair of locking tabs 42 are outwardly biased when the release/engagement lever 34 is forwardly positioned (as in FIG. 1), and upon reaching alignment with the pair of locking slots 58, the pair of locking tabs 42 each outwardly extend into a separate one of the pair of locking slots 58.

The rear face of each of the pair of locking tabs 42 is substantially perpendicular to the longitudinal axis of the elongate handle 14. Upon projecting out of the circular receiving base 48 through the respective ones of the pair of locking slots 58, the locking tabs 42 prevent the elongate handle 14 from being withdrawn from the circular receiving base 48, thus securing the handle/mop connection.

As is also shown in FIG. 1, the mop head 15 includes an outer sleeve 66 received by and extending about the mop head fixture 54, with a plurality of flexible strands 72 extending outward from a base of the outer sleeve 66. In an initial, raised position of the outer sleeve 66 the flexible strands 72 have an elongate length with a first upper band 76 located adjacent the lower edge of the outer sleeve 66.

Proper mop use causes the greatest amount of flexible strand wear to occur at the location of the first upper band 76. When such strands sustain damage upon the extended use of the mop, by lowering the outer sleeve 66 (shown partly in phantom) results in the establishment of a lowered, second upper band 78. Although previously exposed to use, the strand lengths in the second upper band 78 are relatively undamaged in comparison to the strands in the first upper band 76. This second upper band 78 may be used as a (relatively) fresh area of strands, extending the life of the mop as compared to those mops that do not establish such a replacement upper band of flexible mop strands.

FIGS. 1A and 1B illustrate two pairs of retention apertures formed in the mop head fixture 54. One of each pair is a retention aperture 86, preferably the inner-most pair, both of which receive a metal staple strip 92 (see FIGS. 1 and 2). The metal staple strip 92 is part of the mop headband, extending from each side for use in attachment of the flexible strands to the mop fixture 54. The outer-most pair of apertures are provided as water drainage apertures 94, enabling the drainage of such water as may be introduced within the outer sleeve 66 and above the mop fixture 54 during use and cleaning of the mop. Additional avenues for water drainage are provided in the outer sleeve 66, with a plurality of drainage openings 96 formed along both lateral sides, as is depicted in FIG. 2.

As best shown in FIGS. 1 and 2, the metal staple strips 92 extend through the inner pair of retention apertures 86. The protruding ends of the metal staple strips 92 are outwardly bent to extend along and parallel to the top surface of the mop fixture 54.

A staple strip groove 98 is preferably formed in the top surface of the mop fixture 54, and extends to the location of the drainage apertures 94 (at the outer edge of the mop fixture 54). The staple strip groove 98 is sized to receive the metal staple strip 92, further stabilizing and securing its position relative to the mop fixture 54 when the metal staple strip 92 is received within the pairs of retention apertures 86 and secured to the mop fixture 54.

Figures 3, 4, 5:
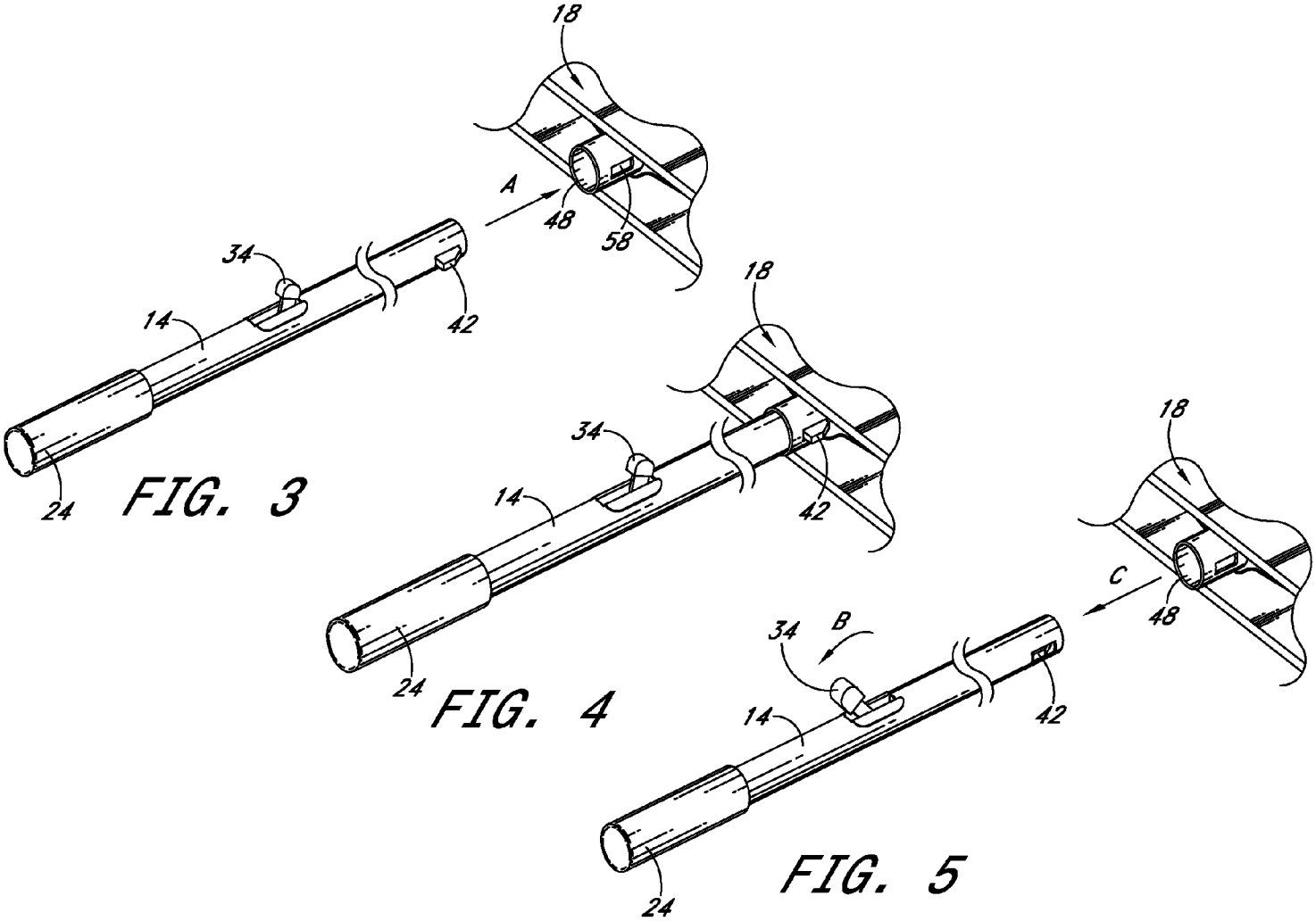
FIG. 3 is a partial perspective view of a handle positioned for engagement with a janitorial tool or implement in accordance with the present invention.
FIG. 4 is a partial perspective view, similar to FIG. 3, of a handle received by and engaged with a janitorial tool or implement in accordance with the present invention.
FIG. 5 is a partial perspective view, similar to FIGS. 3 and 4, of a handle after being withdrawn from engagement with a janitorial tool or implement in accordance with the present invention.

FIGS. 3-5 illustrate a manner of engagement and disengagement of the handle 14 to a long-handled tool, such as the mop head 18. In FIG. 3 the longitudinal axis of the elongate handle 14 is moved into alignment with the longitudinal axis of the circular receiving base 48, and is positioned for engagement with the tool.

The pair of locking tabs 42 are shown projecting from openings formed in the elongate handle 14 and located at a position spaced from the second or forward handle end 28. The projecting pair of locking tabs 42 have an angled leading edge, which causes the locking tabs to be forced inward and into the elongate handle 14 as the handle 14 slides into engagement within the circular receiving base 48 formed in the mop (or other implement) fixture 54, in the direction of Arrow A.

The pair of locking slots 58 formed in the receiving base 48 are of similar outer dimension as the side elevation geometry of the pair of locking tabs 42. The continued insertion of the elongate handle 14 into the receiving base 48 results in the outwardly-biased locking tabs 42 reaching a point of alignment with the locking slots 58, at which point the locking tabs 42 move outward, extending into the locking slots 58 (see FIG. 4). The rear face of the locking tabs 42 is substantially perpendicular to the longitudinal axis of the elongate handle 14, and upon extending out of the circular receiving base 48 through the locking slots 58, the locking tabs 42 prevent the handle 14 from being withdrawn from the receiving base 48 of the mop head 18 (or other implement).

In FIG. 5 the release/engagement lever 34 located adjacent the first handle end 26 has been moved aft, toward the user in a rearward direction from its previous forward, "locked" position. The rearward lever movement, in the direction of Arrow B, is communicated to the locking tabs 42 and results in the retraction of the locking tabs from their outwardly projecting, locked position within the locking slots 58 of the receiving base 48.

With the locking tabs 42 no longer located within the locking slots 58, the elongate handle 14 is no longer "locked" within the receiving base 48 and can be withdrawn in the direction of Arrow C. In this manner, removal of the elongate handle 14 from the mop fixture 54 may conveniently follow retraction of the release/engagement lever 34. The user is not required to directly manipulate the locking tabs located within the mop fixture, and thus need not handle or get in close proximity to the wet mop head 18.

Figure 6:
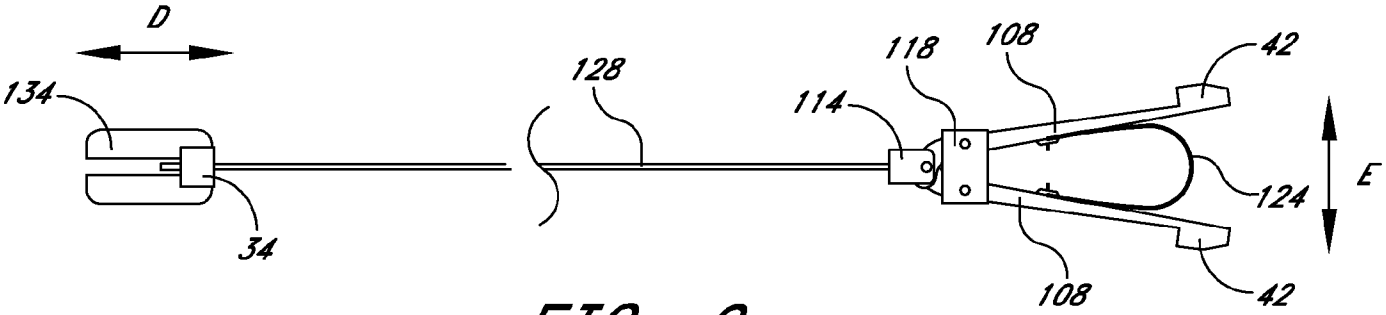
FIG. 6 is a partial top plan view of a cable-activated engagement/release mechanism in accordance with the present invention.
Figure 7:
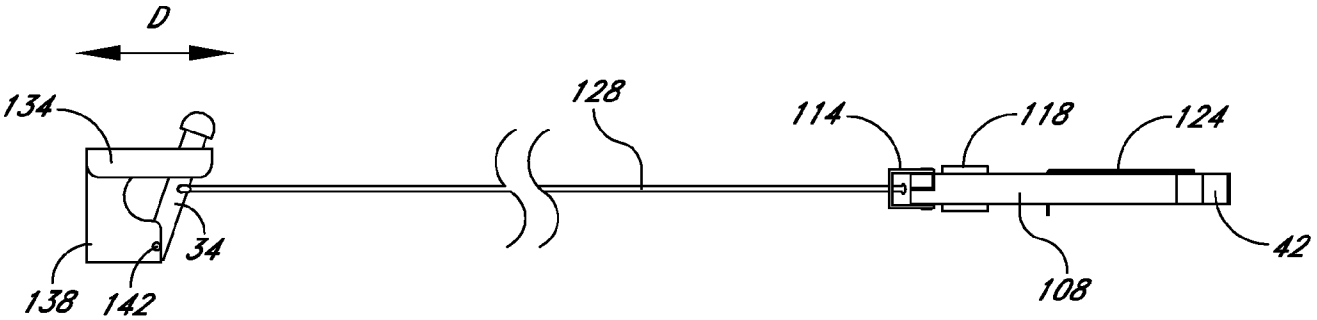
FIG. 7 is a partial side elevation view of the cable-activated engagement/release mechanism of FIG. 6 in accordance with the present invention.

A presently preferred locking tab actuation mechanism is depicted in FIGS. 6 and 7. Each of the pair of locking tabs 42 is formed at a distal end of a locking tab arm 108, with a first end of each of the locking tab arms 108 attached to a cable harness 114. A spacer bar 118 located adjacent the cable harness 114 is pivotally attached to each of the locking tab arms 108. Upon placement of a rearward, pulling force by the cable harness 114 on each of the ends of the locking tab arms 108, the spacer bar 118 permits each of the locking tab arms 108 to inwardly pivot, resulting in the inward movement of each of the locking tabs 42.

A u-shaped flat spring 124 extends between attachment points on inner surfaces of the opposing locking tab arms 108 and biases them in an outward direction. This outward force results in the outward movement of the locking tabs 42 unless overcome by the rearward pull of the cable harness 114 or the insertion of the locking tabs 42 within the circular receiving base 48. In these latter instances, the flat spring 124 is compressed.

A cable 128 extends from the cable harness 114 to a locus of attachment on the release/engagement lever 34. A rearward movement of the release/engagement lever 34 is communicated as a rearward force to the cable harness 114. A forward movement of the release/engagement lever 34 is likewise communicated through the cable 128 and relaxes such rearward force. As discussed above, application of a rearward force on the cable harness 114 causes an inward movement of the locking tab arms 108 (and the locking tabs 42). Upon a relaxation of such rearward force, the u-shaped flat spring 124 forces the locking tab arms 108 and the locking tabs 42 apart. Such reciprocating movement of the release/engagement lever 34 is depicted in FIGS. 6 and 7 by Arrow D, and the resultant reciprocating movement of the locking tabs 42 in FIG. 6 by Arrow E.

A lever housing 134 receives the release/engagement lever 34 with a base member 138 providing a pivot attachment 142 to the release/engagement lever 34 adjacent a lower extension thereof. As so attached, the release/engagement lever 34 is able to pivot relative to the lever housing 134, enabling the fore and aft movement of the release/engagement lever 34 relative to the elongate handle 14.

The manner in which the elongate handle 14 is connected and released from the mop head 18 is illustrated in FIGS. 3-7. The flat spring 124 is compressed when the pair of locking tabs 42 are forced inwardly as the handle 14 is received within the outer walls of the circular receiving base 48. When the pair of locking tabs 42 become juxtaposed and adjacent the pair of locking slots 58 formed in the receiving base 48, the compressed flat spring 124 pushes the pair of locking tabs 42 out and into a "locked" position within, and projecting from, the locking slots 58 (shown in FIG. 4).

In FIG. 5 the release/engagement lever 34 located adjacent an end of the handle 14 held by a user has been moved rearward from its forward, "locked" position, and toward the user. The rearward lever movement is communicated through the internally extending cable 128 to the cable harness 114, and results in an inward movement or retraction of the locking tabs 42 from their outwardly projecting, locked position within the locking slots 58. When the locking tabs 42 are no longer located within the locking slots 58 the elongate handle 14 is no longer "locked" within the circular receiving base 48 and can be withdrawn. In this manner removal of the handle 14 from the mop fixture 54 may conveniently follow retraction of the release/engagement lever 34 located at the user-end of the handle 14. The user is not required to directly manipulate the locking tabs 42 located within the mop fixture 54, and thus need not handle the wet mop head 18.

As is shown in FIGS. 6 and 7 the release/engagement lever 34 is placed in a forward position when the locking tabs 42 are in their outwardly biased position (the flat spring 124 is shown attached to both locking tab arms 108 resulting in this open, outward position of the locking tabs 42). When a user pulls the release/engagement lever 34 away from its forward position, the attached cable 128 is likewise pulled toward the rear, resulting in the application through the cable harness 114 of an inward force against the locking tabs 42, causing both of the locking tabs 42 to move inward and toward one-another. Release of the rearward force applied to the release/engagement lever 34 enables the inner flat spring 124 to once again move both of the locking tabs 42 outward and away from one-another.

Figure 8:
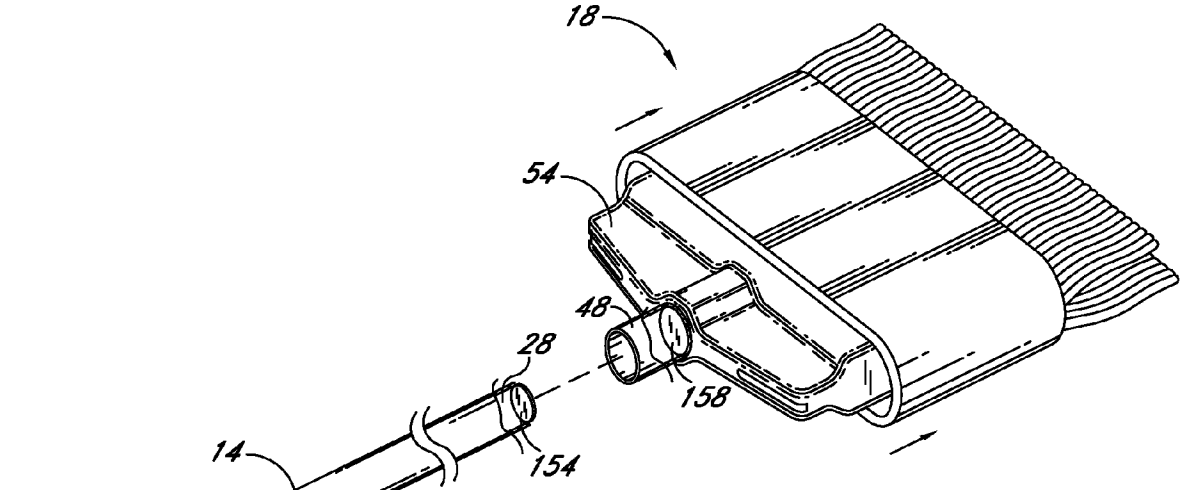
FIG. 8 is an exploded, partial perspective view of an alternative manner of attaching a handle to a mop head.
Figure 9:
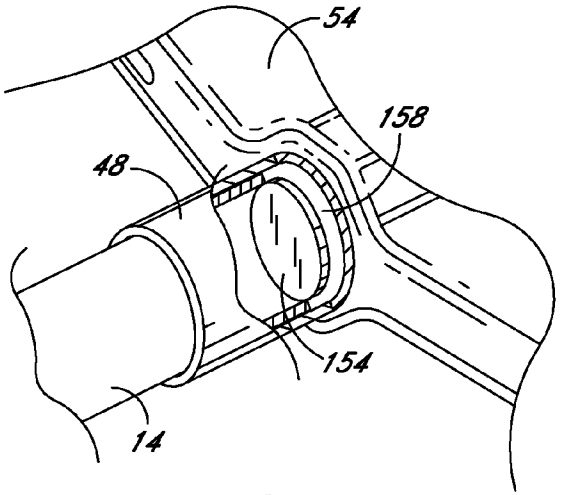
FIG. 9 is an enlarged, partial perspective view, with portions removed and portions shown in cross-section, of the alternative manner of attaching a handle to a mop head, similar to FIG. 8.

FIGS. 8 and 9 show a presently preferred alternative embodiment of the present invention where a strong magnet

154 is placed at the second handle end 28 of the elongate handle 14. A mop fixture 54 (or other implement) includes a ferrous metal piece 158 that is located at the base of the circular receiving base 48. As shown in the enlarged view (FIG. 9), when the strong magnet 154 is brought into contact with the ferrous metal piece 158, the elongate handle 14 becomes attached to the mop fixture 54. Removal of the handle 14 requires the user to over-power the magnetic attractive force, which may be accomplished by the user pulling on the handle 14 while placing one or both feet upon the mop 18. Fabricating the strong magnet 154 out of rare earth materials, such as neodymium, can result in sufficient magnetic forces to maintain the connection while the mop 18 or other implement is in use.

Although only the staple-attached mop head is shown in the Figures, other types of mop heads can be used with this invention, including the triangular mop holder head, the jaw clamp mop head, and a shroud-type mop head (shown in U.S. Pat. No. 5,366,314) as well as such other mop heads as are presently commercially available and in use.

The present inventive connector enables the attachment and detachment of any janitorial item from an elongated handle without the user being required to bend down or physically touch the implement. The present connector may also be used with extended handles, where the implement lies too distant to permit physical access by the user.

As various changes could be made in the above constructions without departing from the scope of the invention, it is intended that all the matter contained in the above description or shown in the accompanying drawings shall be interpreted as illustrative and not in a limiting sense.

What is claimed is:

1. A connector comprising two engageable components for mounting of an elongate handle and an implement fixture respectively, one of said components having a pair of locking tabs and a remotely located lever in mechanical communication with said pair of locking tabs, said pair of locking tabs having a first outwardly extending position and a second inwardly retracted position in response to a first and a second position of said remotely located lever, said one component being mounted on said elongate handle and wherein said pair of locking tabs are located adjacent a first end of said elongate handle and said remotely located lever is adjacent a second end of said elongate handle, and the other component being mounted to said implement fixture, the other component comprising a receiving base formed in said implement fixture and adapted to receive an end of said elongate handle, said receiving base having a pair of apertures formed therein, said pair of apertures configured and positioned to receive said pair of locking tabs in a manner wherein said locking tabs are outwardly biased and selectively extend through said apertures and project from an outer surface of said receiving base, upon insertion of an end of said elongate handle into said receiving base, and further comprising:

a cable attached to and extending between both said remotely located lever and said pair of locking tabs, wherein a first position of said remotely located lever communicates through said cable a pulling force on said pair of locking tabs; and a cable harness attached to an end of said cable, wherein said cable harness is pivotally attached to both of said pair of locking tabs.

2. The connector of claim 1, and further comprising a pair of locking tab arms, each of said arms pivotally attached to said cable harness, and wherein each of said pair of locking tabs is formed on a separate one of said locking tab arms.

* * * * *